US011703792B2

(12) United States Patent
Nakayashiki

(10) Patent No.: US 11,703,792 B2
(45) Date of Patent: Jul. 18, 2023

(54) ATTACHMENT TO PREVENT OVERTURNING OF APPARATUS, OVERTURNING PREVENTION DEVICE, SHEET FEEDING APPARATUS, AND IMAGE FORMING APPARATUS

(71) Applicant: CANON KABUSHIKI KAISHA, Tokyo (JP)

(72) Inventor: Yuji Nakayashiki, Ishikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/667,355

(22) Filed: Feb. 8, 2022

(65) Prior Publication Data

US 2022/0163917 A1 May 26, 2022

Related U.S. Application Data

(63) Continuation of application No. 17/233,244, filed on Apr. 16, 2021, now Pat. No. 11,281,150.

(30) Foreign Application Priority Data

May 11, 2020 (JP) ..... 2020-083169

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
See application file for complete search history.

(56) References Cited

U.S. PATENT DOCUMENTS

| | | | | |
|---|---|---|---|---|
| 9,783,365 | B2 | 10/2017 | Uesugi et al. | B65G 13/06 |
| 10,189,644 | B2 | 1/2019 | Uesugi et al. | B65G 13/06 |
| 11,281,150 | B2 * | 3/2022 | Nakayashiki | G03G 21/1619 |
| 2010/0014886 | A1 | 1/2010 | Lee et al. | 399/107 |
| 2018/0222515 | A1 | 8/2018 | Kawade et al. | B62B 5/049 |

FOREIGN PATENT DOCUMENTS

| | | |
|---|---|---|
| JP | H10-185083 | 7/1998 |
| JP | 2002-252475 | 9/2002 |
| JP | 2003-218544 | 7/2003 |
| JP | 2016-173410 | 9/2016 |
| JP | 2018-011708 | 1/2018 |

* cited by examiner

*Primary Examiner* — Sandra Brase
(74) *Attorney, Agent, or Firm* — Venable LLP

(57) ABSTRACT

An overturning prevention device includes a holding member disposed at a bottom surface portion of an apparatus, and an overturning prevention member configured to be held by the holding member. The apparatus includes a wheel unit including a wheel, a fitting portion, and a support shaft. The holding member is disposed at a position nearer to a center of the bottom surface portion than the support shaft when viewed from above. The overturning prevention member includes, a projecting portion configured to project outside the bottom surface portion, and a held portion configured to be held by the holding member, the projecting portion and the held portion being connected with each other. The overturning prevention member is configured to be attached to and detached from the holding member by being moved in an attaching direction in which the held portion and the projecting portion are connected.

14 Claims, 12 Drawing Sheets

ATTACHMENT TO PREVENT OVERTURNING OF APPARATUS, OVERTURNING PREVENTION DEVICE, SHEET FEEDING APPARATUS, AND IMAGE FORMING APPARATUS

This application is a continuation of application Ser. No. 17/233,244 filed Apr. 16, 2021, currently pending; and claims priority under 35 U.S.C. § 119 to Japan Application JP 2020-083169 filed in Japan on May 11, 2020; and the contents of all of which are incorporated herein by reference as if set forth in full.

BACKGROUND OF THE INVENTION

Field of the Invention

This invention relates to an attachment to prevent overturning of an apparatus, an overturning prevention device, a sheet feeding apparatus including the overturning prevention device, and an image forming apparatus.

Description of the Related Art

An overturning prevention device to prevent overturning of an apparatus is used for an electronic apparatus exemplified by an image forming apparatus such as a printer, a cabinet storing a document, and other apparatuses. The overturning prevention device includes an overturning prevention member supported by an apparatus frame member, and, when the apparatus is inclining by an external force, the overturning prevention member comes into contact with an installation surface of the apparatus, and suppresses an inclination of the apparatus. Japanese Patent Laid-Open No. 2018-11708 describes a configuration in which casters are fitted to four corners of a bottom portion of the apparatus and the overturning prevention members are attached to the four corners of the bottom portion of the apparatus.

However, in the literature mentioned above, a fitting seat of the caster is fixed to a bottom portion of a fitting structure fitted below the bottom surface of the storage apparatus, and the overturning prevention member is inserted into a space between top and bottom portions of the fitting structure. Since, in this configuration, there is the space to insert the overturning prevention member between the fitting seat of the caster and the bottom surface of the storage apparatus, an overall height of the apparatus is increased, and it is a disadvantageous configuration in view of prevention of the overturning.

SUMMARY OF THE INVENTION

The present invention provides new forms of an attachment to prevent overturning of an apparatus, an overturning prevention device, a sheet feeding apparatus including the overturning prevention device, and an image forming apparatus, which are capable of preventing overturing of apparatuses.

According to one aspect of the invention, an overturning prevention device to prevent overturning of an apparatus includes a holding member disposed at a bottom surface portion of the apparatus, and an overturning prevention member configured to be held by the holding member. The apparatus includes a wheel unit including a wheel configured to rotate on an axle, a fitting portion fitted to the bottom surface portion at a position above a top portion of the wheel, and a support shaft extending downward from the fitting portion and supporting the wheel such that the axle is pivotable when viewed from above. The holding member is disposed at a position nearer to a center of the bottom surface portion than the support shaft when viewed from above. The overturning prevention member includes, a projecting portion configured to project outside the bottom surface portion when viewed from above and to face an installation surface on which the wheel is grounded, and a held portion configured to be held by the holding member, the projecting portion and the held portion being connected with each other via a gap between the top portion of the wheel and the fitting portion in a vertical direction. The overturning prevention member is configured to be attached to and detached from the holding member by being moved in an attaching direction in which the held portion and the projecting portion are connected.

According to another aspect of the invention, an attachment to prevent overturning of an apparatus is provided. The apparatus is provided with a wheel unit including a wheel configured to rotate on an axle, a fitting portion configured to be fitted to a bottom surface portion of the apparatus at a position above a top portion of the wheel, and a support shaft extending downward from the fitting portion and supporting the wheel such that the axle is pivotable when viewed from above. The apparatus is provided with a holding member disposed on a bottom surface portion of the apparatus and positioned at a position nearer to a center of the bottom surface portion than the support shaft when viewed from above. The attachment includes a projecting portion configured to project, in an attached state where the attachment is attached to the apparatus, outside the bottom surface portion when viewed from above and to face an installation surface on which the wheel is grounded, a held portion configured to be held by the holding member in the attached state, and a connecting portion connecting the projecting portion and the held portion with each other. An upper surface of the connecting portion is configured to face the fitting portion in a vertical direction in the attached state, and a lower surface of the connecting portion is configured to face a top portion of the wheel in the vertical direction in the attached state. The attachment is configured to be attached to and detached from the holding member by being moved in an attaching direction in which the held portion and the projecting portion are connected.

Further features of the present invention will become apparent from the following description of exemplary embodiments with reference to the attached drawings.

DESCRIPTION OF THE EMBODIMENTS

Hereinafter, exemplary embodiments according to this disclosure will be described with reference to attached drawings.

In the following descriptions, unless otherwise specifically stated, an upper/lower direction of an apparatus indicates the vertical direction in a state where the apparatus is installed on a horizontal surface.

First Embodiment

Figure 1:
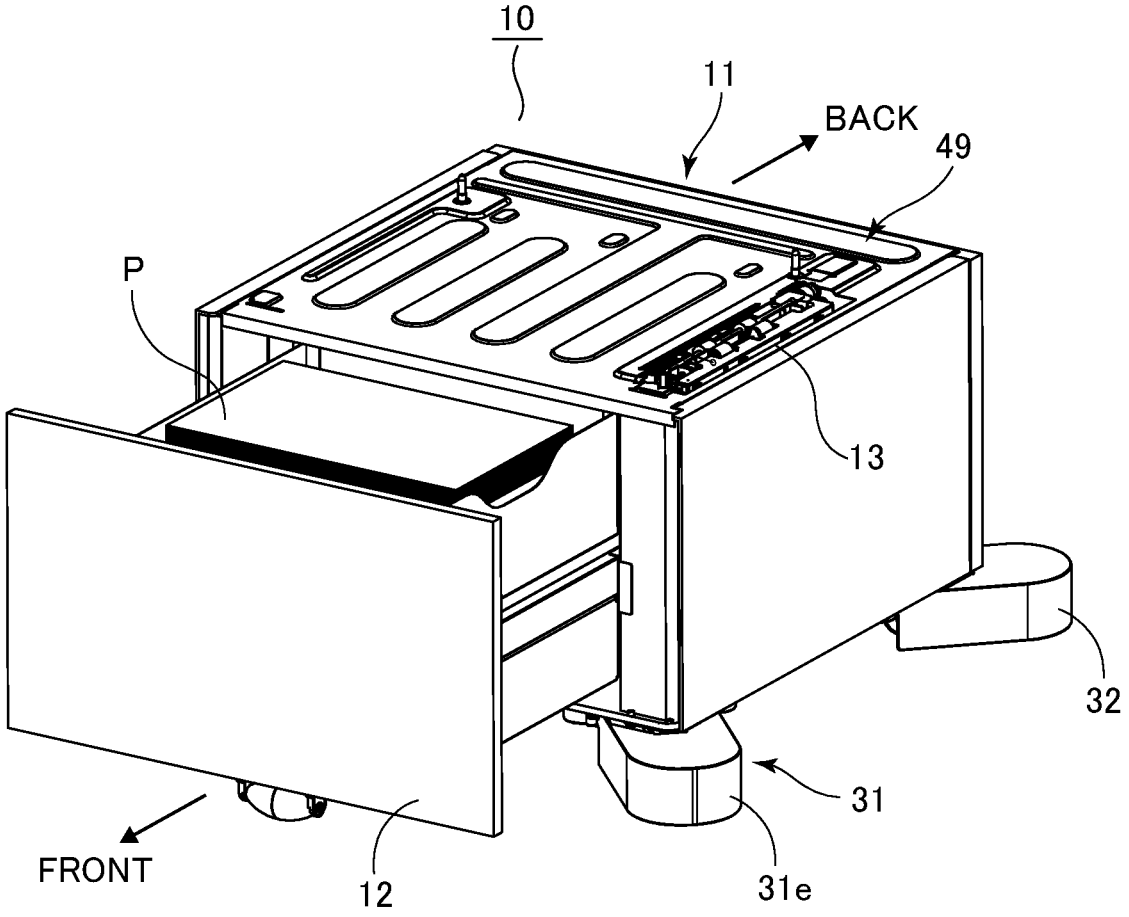
FIG. 1 is a perspective view of a large capacity sheet feeder according to a first embodiment.
Figure 12:
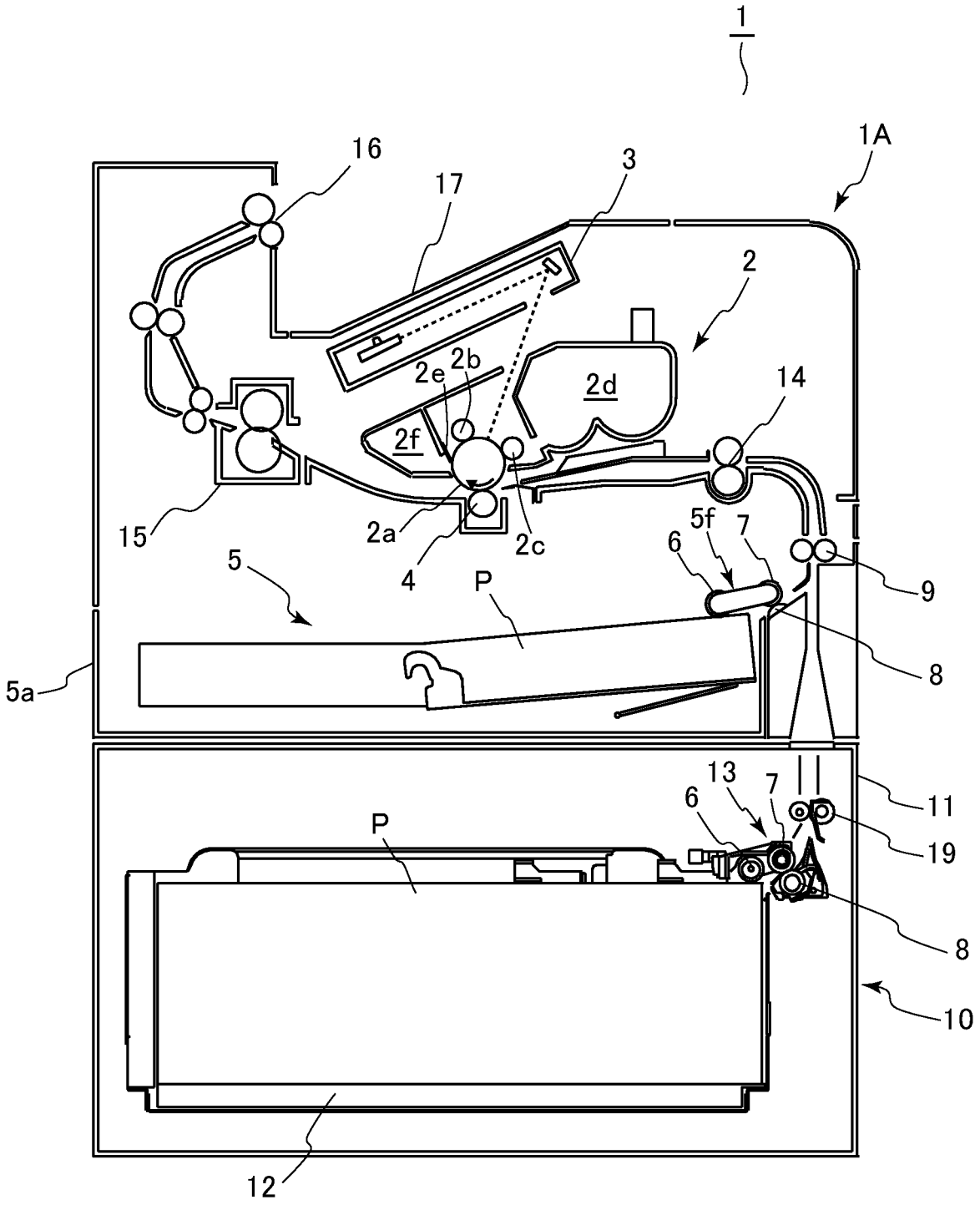
FIG. 12 is a schematic view of an image forming apparatus including the large capacity sheet feeder.

A large capacity sheet feeder 10 which includes an overturning prevention device according to a first embodiment will be described. At first, using FIGS. 1 and 12, outlines of the large capacity sheet feeder 10 and an image forming apparatus 1 will be described. FIG. 1 is a perspective view showing a general arrangement of the large capacity sheet feeder 10 which is an example of a sheet feeding apparatus, and FIG. 12 is a schematic view of the image forming apparatus 1 including the large capacity sheet feeder 10.

As shown in FIG. 1, the large capacity sheet feeder 10 includes a feeder apparatus body 11, a storage chamber 12, and a sheet feed unit 13. The feeder apparatus body 11 is an apparatus body (i.e., casing) of the large capacity sheet feeder 10, and includes frame members constituting a frame body 49, described later, an exterior member fixed to the frame body 49, and the like. The feeder apparatus body 11 has an approximately right-angled parallelepiped shape, and wheel units (i.e., caster) for a movement and the overturning prevention members 31, 32, 33, and 34 (FIG. 1 shows only partly) are disposed at four corners of a bottom portion thereof. Details of the wheel unit and the overturning prevention member will be described later.

The storage chamber 12 is a sheet storage portion to store sheets P used as recording material, and detachably housed inside the feeder apparatus body 11. It is possible to use various kinds of sheets different in sizes and materials as a sheet P including, but not limited to, a paper such as a standard paper and a cardboard, a plastic film, a cloth, various kinds of sheet materials applied with a surface treatment such as a coated paper, and a specially shaped sheet such as an envelope and an index paper.

The sheet feed unit 13 is an example of a sheet feed unit feeding the sheets P stored in the storage chamber 12 one by one to outside the large capacity sheet feeder 10. In this embodiment, the sheet P fed from the sheet feed unit 13 is discharged from a sheet discharge port disposed in an upper surface of the feeder apparatus body 11, and delivered to an upper apparatus mounted on an upper surface of the feeder apparatus body 11.

The large capacity sheet feeder 10 is usable as an optional unit coupled to a lower portion of an image forming apparatus body, which is capable of performing as the image forming apparatus alone. In this case, the large capacity sheet feeder 10 operates the sheet feed unit 13 in accordance with an instruction from the image forming apparatus body, and supplies the sheet P toward the image forming apparatus body.

Further, it is also possible to mount a small capacity sheet feeder on the large capacity sheet feeder 10, and further mount the image forming apparatus body on the small capacity sheet feeder. Further, it is also possible to mount a sheet inversion apparatus for a duplex printing on the large capacity sheet feeder 10. That is, it is possible to use the large capacity sheet feeder 10 with the upper apparatus mounted on the feeder apparatus body 11 in accordance with a configuration of a sheet handling apparatus such as the image forming apparatus. To be noted, it is possible not to connect the large capacity sheet feeder 10 to a lower part of the upper apparatus, by arranging a sheet discharge direction of the sheet from the large capacity sheet feeder 10, for example, in a horizontal direction.

Image Forming Apparatus

A case where the large capacity sheet feeder 10 is used as the optional unit coupled to an image forming apparatus body 1A, which is capable of performing as a monochromic laser beam printer alone as shown in FIG. 12, will be described as a usage example of the large capacity sheet feeder 10. That is, the image forming apparatus 1 shown in FIG. 12 is constituted by the large capacity sheet feeder 10 and the image forming apparatus body 1A removably mounted on the upper surface of the large capacity sheet feeder 10.

The image forming apparatus body 1A shown in FIG. 12 includes an image forming unit 2 which is an electrophotographic unit, and a sheet feeding portion 5 which is a sheet feeding apparatus built in the image forming apparatus body 1A. When an instruction of image formation is input to the image forming apparatus 1, the image forming unit 2 starts an image forming process. That is, a charge roller 2*b* charges a surface of a photosensitive drum 2*a*, which is an image bearing member (i.e., electrophotographic photoreceptor), and a laser scanner 3 irradiates the photosensitive drum 2*a* with a laser beam modulated based on image information to be printed so that an electrostatic latent image is written on the drum surface. A development roller 2*c* supplies charged toner particles to the photosensitive drum 2*a*, and develops the electrostatic latent image to a toner image. The toner consumed by development process is replenished from a toner container 2*d*.

In parallel with the image forming process, the sheets P are fed one by one from the sheet feeding portion 5 or the large capacity sheet feeder 10. A sheet feed unit 5*f* of the sheet feeding portion 5 feeds the sheets P stacked in a cassette 5*a* drawably attached to the image forming apparatus body 1A. The sheet feed unit 13 of the large capacity sheet feeder 10 feeds the sheets P stored in the storage chamber 12. Each of the sheet feed units 5*f* and 13 includes a pickup roller 6, a feed roller 7, and a separation roller 8. The sheet P sent out by the pickup roller 6 from the cassette 5*a* or the storage chamber 12 is separated into one sheet at a time and conveyed by the feed roller 7 and the separation roller 8. To be noted, since the maximum stackable height of the sheets P in the storage chamber 12 is larger than the maximum stackable height of the sheets P in the cassette 5*a*, the storage chamber 12 is capable of storing larger quantity of the sheets P than the cassette 5*a*.

A torque limiter is built in the separation roller 8 mentioned above, and a limit value of the torque limiter is set so that the separation roller 8 rotates following the feed roller 7 when one sheet P is conveyed to a separation nip portion formed by the feed roller 7 and the separation roller 8. Further, when a plurality of sheets enter into the separation nip portion, the separation roller 8 stops and does not rotate following the feed roller 7. To be noted, it is acceptable to input a drive to the separation roller 8 so as to convey the sheet in an opposite of a direction in which the sheet is conveyed by the feed roller 7. Further, the sheet feed units 5*f* and 13 are one of examples of a sheet feed unit, and, for example, it is acceptable to use a conveyance unit conveying the sheet by generating negative pressure inside a belt member with a ventilation hole opened and by sucking the sheet on the belt member.

The sheet P fed from the sheet feeding portion 5 or the large capacity sheet feeder 10 is conveyed via conveyance roller pairs 9 and 19, and a skew of the sheet P is corrected by being abutted onto a registration roller pair 14. The registration roller pair 14 sends the sheet P into a transfer portion between the photosensitive drum 2*a* and a transfer roller 4 in a timing synchronizing with the image forming process performed by the image forming unit 2. Then, by applying a bias voltage to the transfer roller 4, the toner image is transferred from the photosensitive drum 2*a* to the sheet P. An adhesive matter, such as a residual toner, remained on the drum is removed by a cleaning blade 2*e*, and collected to a waste toner container 2*f*.

The sheet P with the toner image transferred is conveyed to a fixing unit 15. The fixing unit 15 provides the toner image on the sheet with heat and pressure while nipping and conveying the sheet P by a heating roller and a pressing roller. Since the toner is herewith melted and thereafter adhered, the image is fixed on the sheet P. The sheet P passed through the fixing unit 15 is discharged to a sheet discharge tray 17 by a sheet discharge roller pair 16.

The image forming unit 2 described above is an example of an image forming unit, and it is acceptable to replace with an electrophotographic unit of an intermediate transfer system which transfers the toner image formed on the image bearing member via an intermediate transfer member such as an intermediate transfer belt. Further, it is acceptable to use an image forming unit of an ink jet printing system, an offset printing system, and the like other than the electrophotographic system for the image forming unit.

Outline of Frame Body

Figure 2:
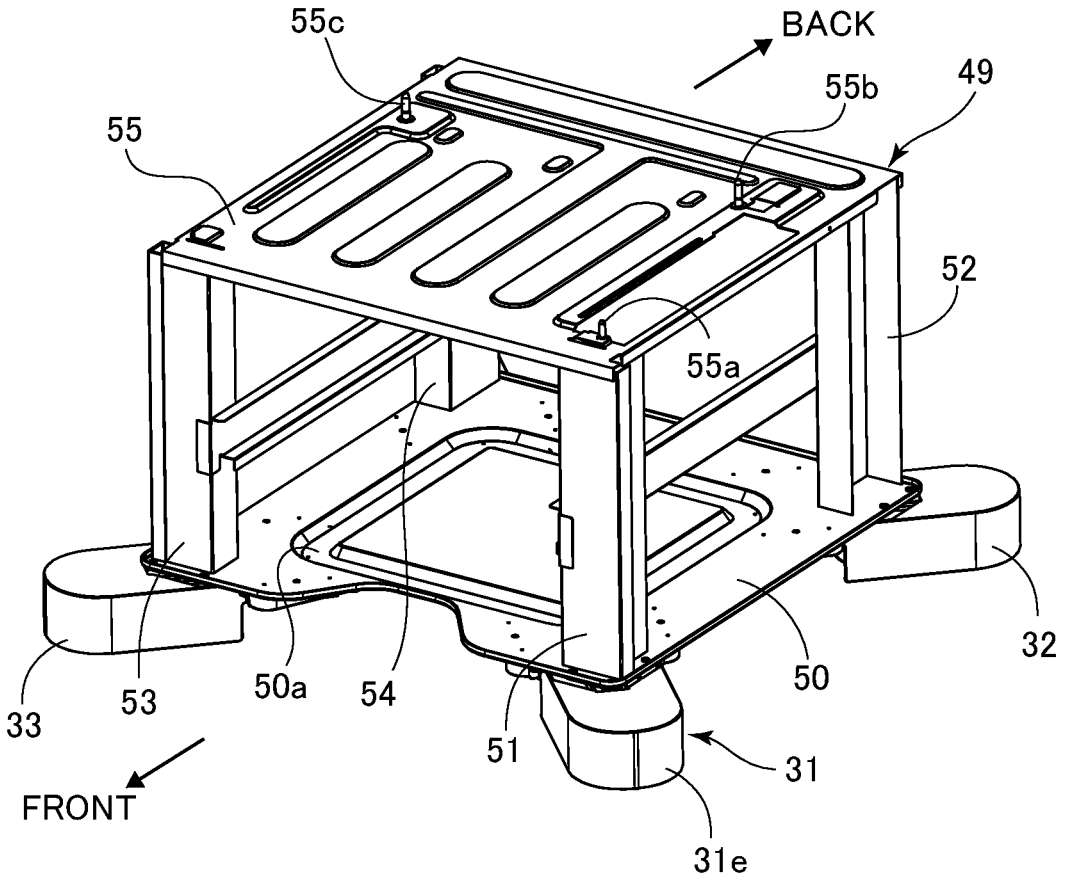
FIG. 2 is a perspective view showing a frame body of the large capacity sheet feeder according to the first embodiment.

Next, using FIG. 2, a frame body configuration of the large capacity sheet feeder 10 will be described. FIG. 2 is a perspective view showing the frame body 49 of the large capacity sheet feeder 10 with the storage chamber 12, exteriors and the like being removed.

The frame body 49 includes a lower frame 50 constituting a bottom surface (i.e., lower surface) of the feeder apparatus body 11, a top plate 55 constituting a top surface (i.e., upper surface) of the feeder apparatus body 11, and columns 51, 52, 53, and 54 coupling four corners of the lower frame 50 to four corners of the top plate 55 and each extending in the upper/lower direction. On the top plate 55, positioning pins 55*a*, 55*b*, and 55*c* are disposed to ensure a positional relation at a mounting of the upper apparatus on the large capacity sheet feeder 10. The storage chamber 12 is housed in an approximately right-angled parallelepiped shaped space surrounded by the lower frame 50, the top plate 55, and the columns 51 to 54. Hereinafter, a side to which the storage chamber 12 is drawn out is referred to as a front side of the feeder apparatus body 11, and an opposite side of the front side is referred to as a back side of the feeder apparatus body 11.

The lower frame 50 is a plate shaped member spreading approximately perpendicularly to the upper/lower direction. A bending shape 50*a* which is uneven (i.e., protruded and/or depressed shape) in an out-of-plane direction is formed, preferably by a drawing method or the like, in the lower frame 50. By providing the bending shape, stiffness of the lower frame 50 is improved. A pattern of the bending shape 50*a* is not limited to the illustrated rectangular shape, and it is acceptable to change suitably so as to acquire a necessary strength.

Structure of Bottom Portion of Large Capacity Sheet Feeder

Figure 3:
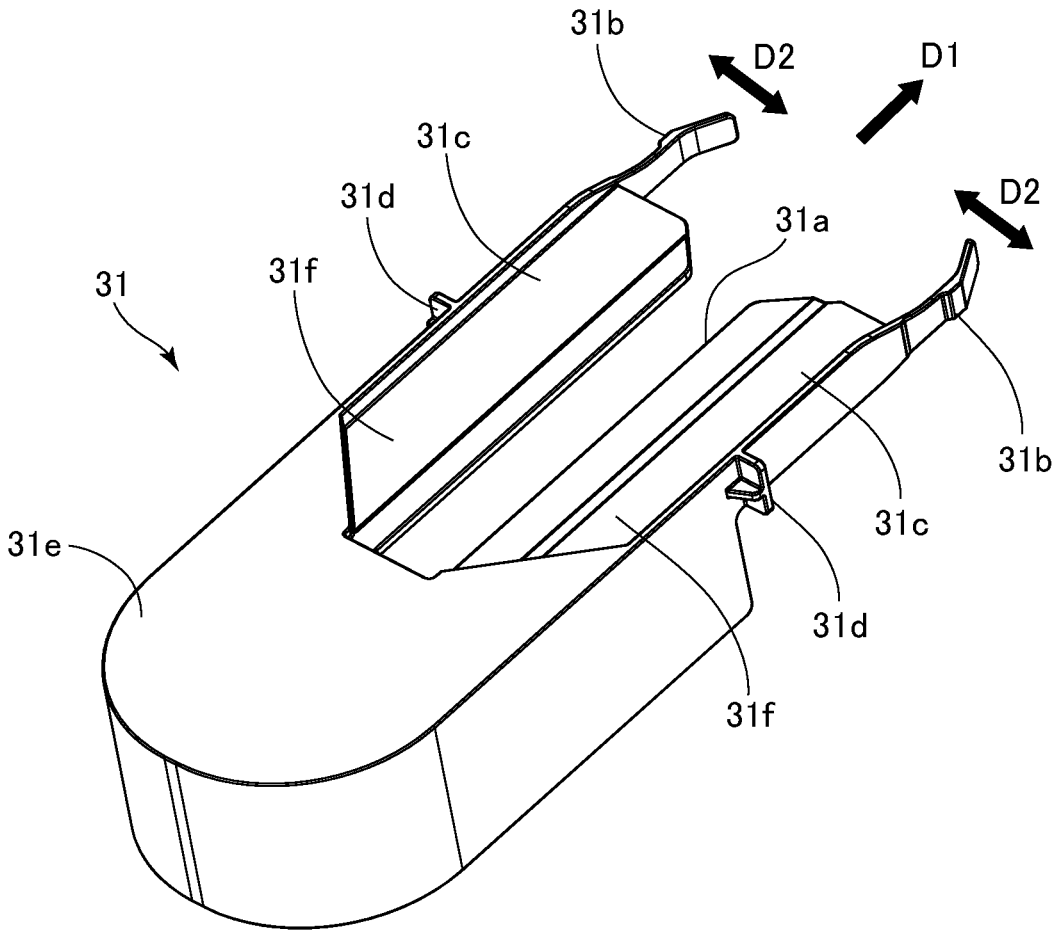
FIG. 3 is a perspective view of one of overturning prevention members according to the first embodiment.
Figure 4:
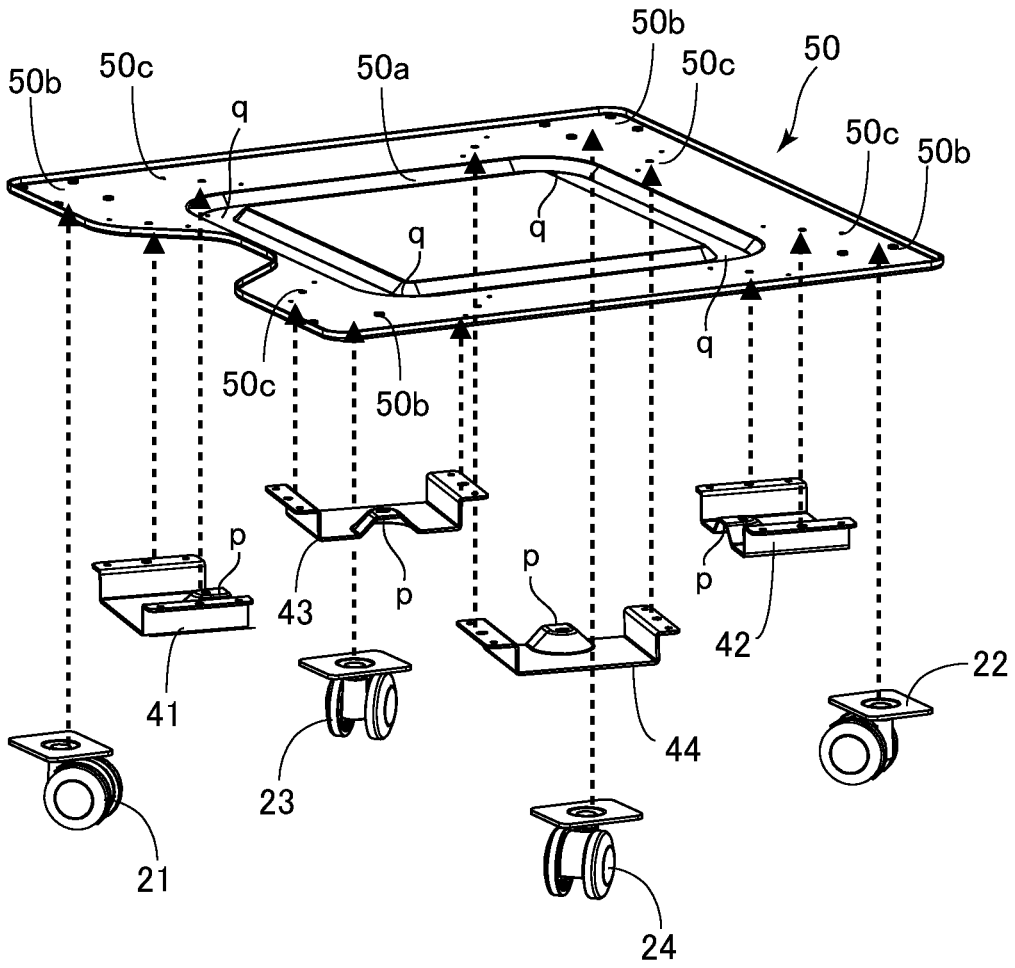
FIG. 4 is a diagram for an explanation of relations among a lower frame of the large capacity sheet feeder, casters, and holding portions for the overturning prevention members according to the first embodiment.
Figure 5A:
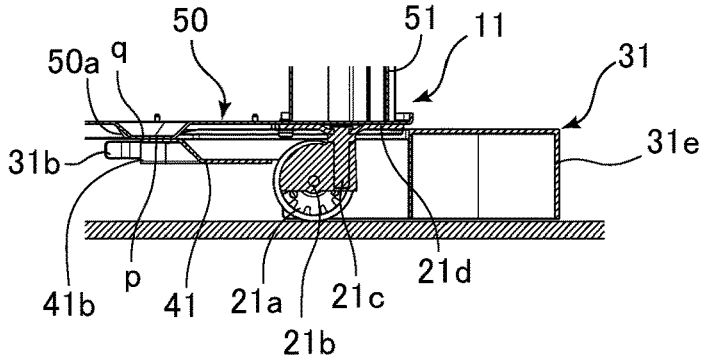
FIGS. 5A to 5C are cross-sectional views of the large capacity sheet feeder for an explanation of a configuration of the overturning prevention member according to the first embodiment.
Figure 5B:
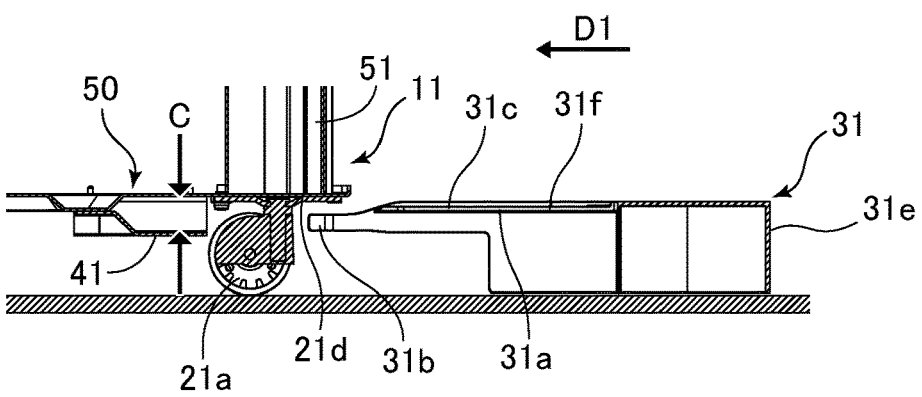
Figure 5C:
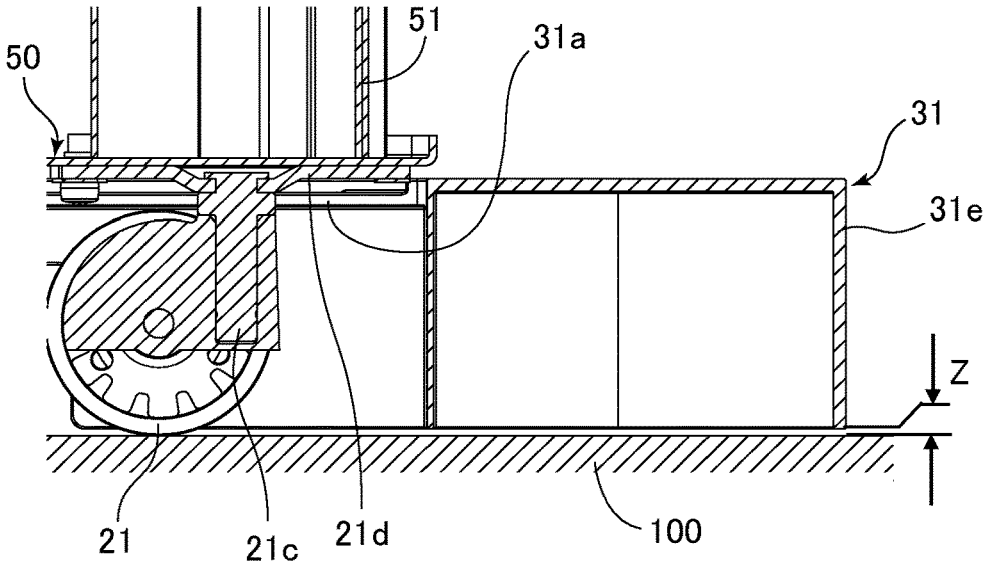
Figure 6:
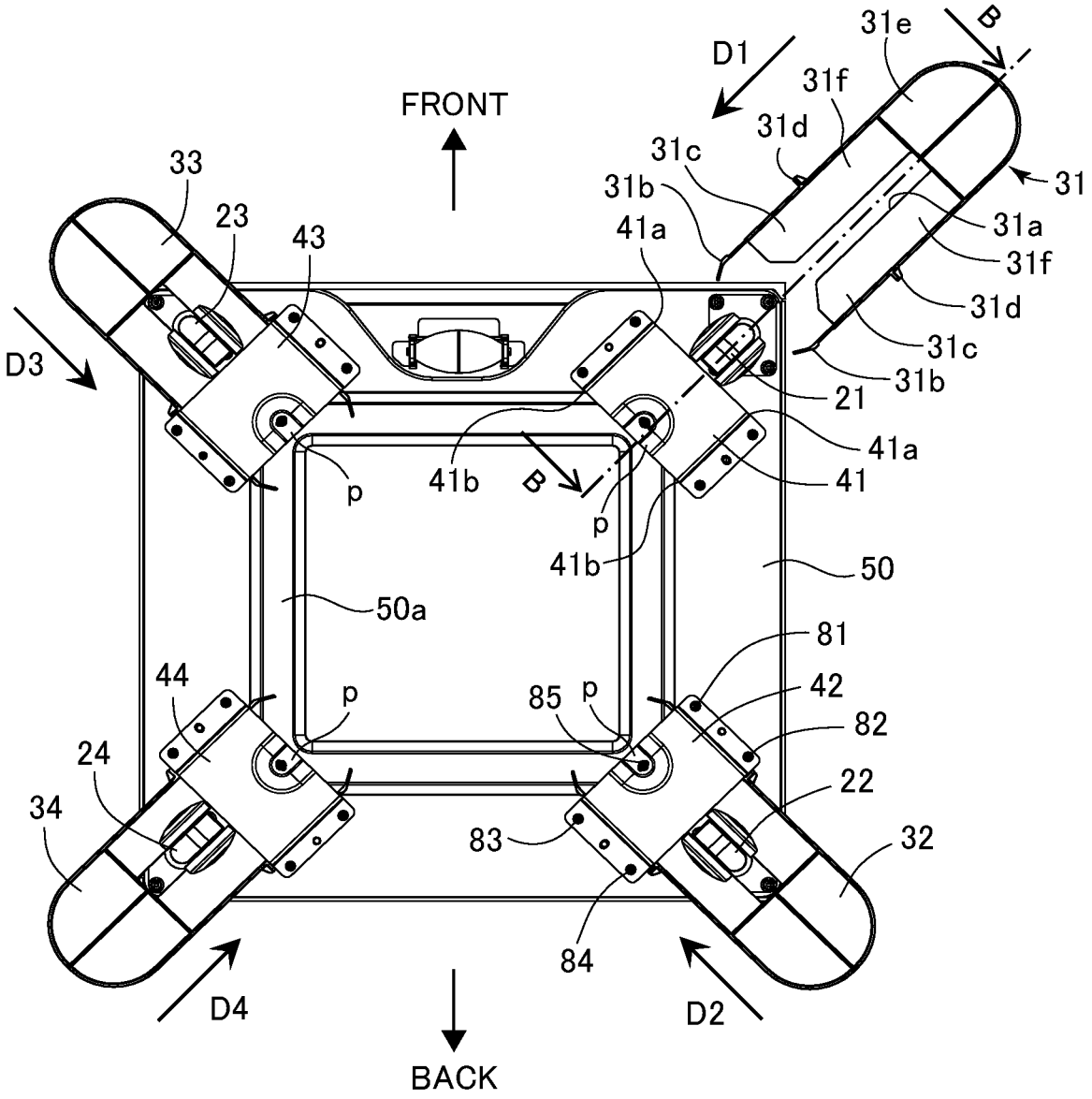
FIG. 6 is a bottom view of the large capacity sheet feeder for the explanation of the configuration of the overturning prevention member according to the first embodiment.

Using FIGS. 3 to 6, a structure disposed at a bottom portion of the large capacity sheet feeder 10 will be described. FIG. 3 is a perspective view of the overturning prevention member 31. FIG. 4 is a perspective view showing relations of holding members 41 to 44 and wheel unit 21, 22, 23, and 24, which are attached to the lower frame 50, with respect to the lower frame 50 of the feeder apparatus body 11. FIGS. 5A to 5C are cross-sectional views of the large capacity sheet feeder 10 taken along a line B-B in FIG. 6. FIG. 6 is a view of the large capacity sheet feeder 10 with the overturning prevention members 31 to 34 attached when viewed from below.

As shown in FIGS. 1 and 6, a structure including four overturning prevention members 31 to 34 and the holding members 41 to 44 is disposed at the bottom portion of the large capacity sheet feeder 10 so as to prevent overturning of the large capacity sheet feeder 10. Each of the overturning prevention members 31 to 34 is a detachable attachment attached to the large capacity sheet feeder 10 for preventing overturning thereof. The holding members 41 to 44 constitute the bottom portion of the feeder apparatus body 11 with the lower frame 50. The holding members 41 to 44 each serve as a holding portion (i.e., overturning prevention member supporting portion) to hold each of the overturning prevention members 31 to 34. To be noted, FIG. 6 illustrates a state where the holding member 31 disposed on a front right side of the large capacity sheet feeder 10 is detached from the feeder apparatus body 11 (i.e., detached state or non-attached state). The other three overturning prevention members 32 to 34 are illustrated in a state attached to the feeder apparatus body 11 (i.e., attached state).

Since a configuration of each of the overturning prevention members 31 to 34 is substantially the same, using the overturning prevention member 31 shown in FIG. 3, the configurations of the overturning prevention members 31 to 34 will be described. The overturning prevention member 31 includes a held portion 31*c*, a connecting portion 31*f*, and a grounding portion 31*e*.

The held portion 31*c* is a portion which is held by the holding member 41 of the feeder apparatus body 11. The held portion 31*c* is a portion which are inserted into an attaching space C (refer to FIG. 5B) between the holding member 41 and the lower frame 50 disposed at the feeder apparatus body 11 at a time of attaching the overturning prevention member 31. Hereinafter, a direction in which the overturning prevention member 31 moves so as to insert the held portion 31*c* into the attaching space C is referred to as an attaching direction D1 of the overturning prevention member 31.

Two parts (each denoted by "31*c*") of the held portion 31*c* each extend from the grounding portion 31*e* in the attaching direction D1, and a slit 31*a* is a groove shape extending in the attaching direction D1 between the two parts of the held portion 31*c*. In other words, the overturning prevention member 31 is attached to and detached from the feeder apparatus body 11 by being moved in a direction connecting the grounding portion 31*e*, which is a projecting portion, and the held portion 31*c*. When viewed in the attaching direction D1, the two parts of the held portion 31*c* are in a substantially horizontal line. That is, when viewed from above, the two parts of the held portion 31*c* are separated from each other in a direction intersecting with the attaching direction D1 (preferably, orthogonally intersecting direction). A width of the slit 31*a* is set at a width capable of accommodating a main shaft 21*c* of a wheel unit 21. Further, the slit 31*a* is opened downstream in the attaching direction D1. Arms 31*b* are disposed at ends of the two parts of the held portion 31*c* in the attaching direction D1.

The overturning prevention member 31 is, for example, integrally formed of a synthetic resin having excellent strength into one component, and each of the arms 31*b* is capable of deforming elastically in a deformation direction D2 intersecting with the attaching direction D1. Contact portions 31*d* project from the two parts of the held portion 31*c* in a direction intersecting with the attaching direction D1, preferably in the same direction as the deformation direction D2 of the arms 31*b*. The other overturning prevention members 32 to 34 include the configuration substantially the same as the overturning prevention member 31 as described above.

The grounding portion 31*e* is the projecting portion, when viewed from above, projecting outside the lower frame 50 so as to face an installation surface of the large capacity sheet feeder 10 outside the lower frame 50 (refer to FIGS. 1 and 5A). The grounding portion 31*e* is formed to cover the wheel unit 21 at least in a case where the bottom portion of the apparatus is viewed from a range between the front side and a right side in FIG. 1.

The connecting portion 31*f* is a portion, when viewed from above, connecting the held portion 31*c*, which is held by the holding member 41 on an inner side of the main shaft 21*c* of the wheel unit 21 with respect to the lower frame 50, and the grounding portion 31*e* projecting outside the lower frame 50. The overturning prevention member 31 of this embodiment the connecting portion 31*f* includes two parts each denoted by "31*f*" and serving as a first connecting part and a second connecting part. The two parts of the connecting portion 31*f* each continue to extend in the attaching direction D1 to either one of the two parts of the held portion 31*c*, which serve as a first held part and a second held part. Further, the slit 31*a* described above is also formed between the two parts of the connecting portion 31*f*. The connecting portion 31*f* and the held portion 31*c* form a body part of the overturning prevention member 31 which is, when viewed from above, positioned on an inner side of the lower frame 50 with respect to the grounding portion 31*e* projecting outside the lower frame 50. Parts of the connecting portion 31*f* and the held portion 31*c*, which become edges of the slit 31*a*, are formed, for example, in a plate shape spreading approximately perpendicularly to the upper/lower direction.

The attaching directions D1 to D4 of the overturning prevention members 31 to 34 to the feeder apparatus body 11 are different from each other, and, for example, when viewed from above, the attaching directions D1 to D4 deviate by 90 degrees from each other. Further, projecting directions of the overturning prevention members 31 to 34 with respect to the feeder apparatus body 11 are different from each other, and, for example, the overturning prevention members 31 to 34 are disposed so as to project into opposite directions of the respective attaching directions D1 to D4.

As shown in FIGS. 4 and 6, the wheel units 21 to 24 are fixed to screw holes 50*b* (refer to FIG. 4) disposed at four corners of a lower surface of the lower frame 50 by a plurality of screws. Further, as shown in FIGS. 4 and 6, the holding members 41, 42, 43, and 44 holding the overturning prevention members 31 to 34 are disposed at four corners of the lower surface of the lower frame 50 and in adjacent to attaching positions of the wheel units 21 to 24. Each of the holding members 41 to 44 is a member fixed to screw holes 50*c* disposed in the lower surface of the lower frame 50 by a plurality of screws (in FIG. 6, only screws 81, 82, 83, and 84 of the holding member 42 are illustrated).

Detail of Overturning Prevention Member

Using FIGS. 5A to 5C, 6, and 7, positional relations of the overturning prevention members 31 to 34 and peripheral components will be described in further detail, and a performance of the overturning prevention members 31 to 34 will be described. FIGS. 5A to 5C are cross-sectional views of the large capacity sheet feeder 10 taken along the line B-B in FIG. 6. Among these, FIG. 5B shows the detached state in FIG. 6 where the overturning prevention members 31 is detached from the feeder apparatus body 11, FIG. 5A shows the attached state where the overturning prevention members 31 is attached, and FIG. 5C is an enlarged view where a part of FIG. 5A is enlarged.

At first, the wheel units 21 to 24 disposed in adjacent to the overturning prevention members 31 to 34 will be described. Since a configuration of each of the wheel units 21 to 24 is substantially the same, using the wheel unit 21 shown in FIG. 5A, the configurations of the wheel units 21 to 24 will be described. The wheel unit 21 includes a wheel 21*a* coming into contact with (i.e., grounded on) an installation surface 100, an axle 21*b* rotatably supporting the wheel 21*a*, the main shaft 21*c* serving as a support shaft supporting the axle 21*b*, and a support plate 21*d* integrally disposed with the main shaft 21*c*. The wheel 21*a* is rotatable on the axle 21*b* extending approximately horizontally, and pivotable (i.e., capable of revolving) around the main shaft 21*c* extending downward from the support plate 21*d* approximately in the upper/lower direction. The support plate 21*d* is a fitting portion (seat surface portion) fixed to the lower frame 50 by the plurality of screws.

At this point, as shown in FIG. 5C, the main shaft 21*c* extends higher than a height of a top portion of the wheel 21*a*. Further, the support plate 21*d* is also positioned above the top portion of the wheel 21*a*, and a space is ensured below the support plate 21*d* so as to enable a revolution of the wheel 21*a*. A gap is disposed between the top portion of the wheel 21*a* and the support plate 21*d* in the upper/lower direction.

As shown in FIGS. 5A and 6, the wheel unit 21 is disposed right under the corner of the lower frame 50, and faces the column 51 (refer to FIG. 2) across the lower frame 50. For example, when viewed from above, a connecting portion of the column 51 with the lower frame 50 and the support plate 21*d* of the wheel unit 21 are in a positional relation overlapping each other. Similarly, at the bottom portion of the large capacity sheet feeder 10, the wheel units 22 to 24 are disposed right under the corners of the lower frame 50, and face the columns 52 to 54 (refer to FIG. 2) across the lower frame 50.

The wheel units 21 to 24 and the columns 51 to 54 are a main part of a support structure supporting a weight of the large capacity sheet feeder 10 (including a weight of the sheet stored in the storage chamber 12) and a weight of the upper apparatus. Therefore, the frame body 49 of the feeder apparatus body 11 is generally designed to provide adequate stiffness to adjacencies, including the lower frame 50, of the wheel unit 21.

As shown in FIG. 6, each of the holding members 41 to 44 holding the overturning prevention members 31 to 34 is disposed on an inner side of the nearest wheel units 21 to 24 (especially, with respect to a position of the main shaft) with respect to the feeder apparatus body 11 in the attaching directions D1 to D4 of the overturning prevention members 31 to 34. That is, the holding member is disposed at a position nearer to a center of the bottom surface portion than the support shaft when viewed from above.

The holding members 41 to 44 have an approximately rectangular shape with one side opening upward (angular C-shape) when viewed in the attaching directions D1 to D4 of the overturning prevention members 31 to 34. Therefore, the attaching space C (refer to FIG. 5B) is formed at the bottom portion of the feeder apparatus body 11 between the lower surface of the lower frame 50 and the holding members 41 to 44 in the upper/lower direction. That is, the lower frame 50 and the holding members 41 to 44 form the attaching spaces C into which the overturning prevention members 31 to 34 are inserted from an outside to inside of the feeder apparatus body 11 in the predetermined attaching directions D1 to D4. In other words, the attaching spaces C of this embodiment are disposed as holes penetrating through in the attaching directions D1 to D4 between the lower surface of the lower frame 50 and the holding members 41 to 44 in the upper/lower direction.

To be noted, in this embodiment, the holding members 41 to 44 are disposed outside a bending shape 50*a* of the lower frame 50 (refer to FIG. 6). Further, at a bottom portion of each of the holding members 41 to 44, a projecting portion p projecting upward is disposed (refer to FIG. 4), and the projecting portion p is fixed to a corner portion q by a screw in a state coming into contact with the corner portion q of the bending shape 50*a* in an approximately rectangular shape (also refer to FIG. 5A). The configuration as described above has an advantage to increase the stiffness of the structure (bottom surface portion of the feeder apparatus body 11) constituted by the lower frame 50 and the holding members 41 to 44.

A method to attach the overturning prevention members 31 to 34 will be described below, using the overturning prevention member 31 as an example. As shown in FIGS. 5B and 6, in a case attaching the overturning prevention member 31, an operator grips the overturning prevention member 31 with the held portion 31*c* directed to a downstream side in the attaching direction D1, and aligns the slit 31*a* to face the main shaft 21*c* of the wheel unit 21. Then, the operator moves the overturning prevention member 31 from an outside to inside of the feeder apparatus body 11 in the attaching direction D1.

In a process of pushing the overturning prevention member 31 in the attaching direction D1, the main shaft 21*c* of the wheel unit 21 enters into the slit 31*a*. That is, the held portion 31*c* moves via a gap between the top portion of the wheel 21*a* and the support plate 21*d* in the upper/lower direction on both sides of the slit 31*a* while the slit 31*a* is accommodating the main shaft 21*c*. Further, the arms 31*b* of the overturning prevention member 31 come into contact with front side edge portions 41*a* disposed at an upstream edge of the holding member 41 in the attaching direction D1, and elastically deform inward (that is, so as to approach to each other).

When the overturning prevention member 31 is further pushed in, the main shaft 21*c* relatively moves toward the bottom side of the slit 31*a*, and the arms 31*b* move sliding with a side surface portion of the holding member 41. Then, by bringing the contact portions 31*d* of the overturning prevention member 31 into contact with the front side edge portions 41*a* of the holding member 41, movement of the overturning prevention member 31 in the attaching direction D1 is restricted. A position of the overturning prevention member 31 at which the contact portions 31*d* come into contact with the front side edge portions 41*a* is hereinafter referred to as an attached position of the overturning prevention member 31.

The holding member 41 holds the held portion 31*c* so that the overturning prevention member 31 is held at the attached position and brought into a state held by the feeder apparatus body 11. In this state, the arms 31*b* are at positions passed through the holding member 41 in the attaching direction D1, and are engaging with back side edge portions 41*b* which are at a downstream edge of the holding member 41 in the attaching direction D1. The arms 31*b* have a claw shape with the larger maximum width than a width of the back side edge portions 41*b* in the deformation direction D2, and prevent the overturning prevention member 31 from dropping off from the holding member 41 to an upstream side in the attaching direction D1 by engaging with the back side edge portions 41*b*. In other words, the arms 31*b* of the overturning prevention member 31 and the back side edge portions 41*b* of the holding member 41 form a snap fit mechanism which prevents the overturning prevention member 31 from dropping off.

As shown in FIG. 5C, assuming the installation surface 100 is horizontal, a shape and the like of the overturning prevention member 31 are designed to secure a predetermined gap Z between the grounding portion 31*e* of the overturning prevention member 31 and the installation surface 100 in a state where an external force is not applied to the feeder apparatus body 11. That is, a lower edge of the grounding portion 31*e* extends downward with respect to the connecting portion 31*f* extending via the gap between the top portion of the wheel 21*a* and the support plate 21*d* in the upper/lower direction as described later, and is positioned, at least, below a rotational axis of the wheel 21*a*. Herewith, it is possible to attach and detach the overturning prevention member 31 while keeping the large capacity sheet feeder 10 in a state installed on the installation surface 100. Further, it is possible to move the large capacity sheet feeder 10 by the wheel units 21 to 24 with the overturning prevention member 31 attached.

Figure 7:
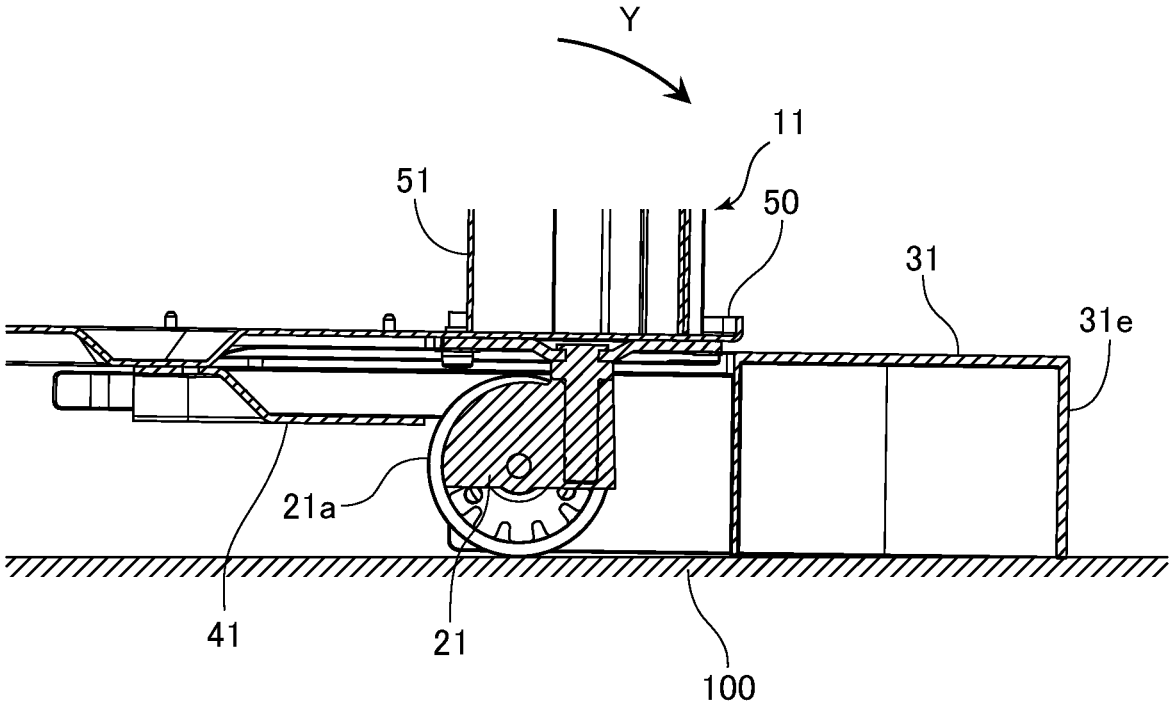
FIG. 7 is a cross-sectional view of the large capacity sheet feeder for an explanation of a function of the overturning prevention member according to the first embodiment.

FIG. 7 shows an aspect of the overturning prevention member 31 when the external force is applied to the large capacity sheet feeder 10. In FIG. 7, the feeder apparatus body 11 starts to incline in a clockwise direction in the figure (arrow Y direction) around a contact portion of the wheel unit 21 and the installation surface 100 as a fulcrum by the external force. At this time, since the grounding portion 31*e* of the overturning prevention member 31 is brought into contact with the installation surface 100 by a slight inclination of the feeder apparatus body 11, the frame body 49 of the feeder apparatus body 11 is supported by the overturning prevention member 31, and the feeder apparatus body 11 is prevented from overturning. That is, the inclination of the feeder apparatus body 11 is restricted by a reaction force received by the overturning prevention members 31 from the installation surface 100.

As described above, in this embodiment, the holding member 41 holding the overturning prevention member 31 is disposed on the inner side of the main shaft 21*c* of the wheel unit 21 with respect to the lower frame 50 in the attaching direction D1. That is, the overturning prevention members 31 is held by the holding member 41, when viewed from above, on an inner side of an outer edge of the lower frame 50 and on an opposite side of the grounding portion 31*e* with respect to the main shaft 21*c*. Further, the grounding portion 31*e* projecting outside the lower frame 50 and the held portion 31*c* held by the holding member 41 on the inner side of the main shaft 21*c* are connected with each other by the connecting portion 31*f* extending via the gap between the top portion of the wheel 21*a* and the support plate 21*d* in the upper/lower direction. In other words, in the overturning prevention members 31, an upper surface of the connecting portion 31*f* faces the lower surface of the lower frame 50 in the upper/lower direction, and a lower surface of the connecting portion 31*f* faces the top portion of the wheel 21*a* in the upper/lower direction.

By this configuration, it is possible to avoid overlapping a fitting position of the wheel unit 21 with the holding member 41 of the overturning prevention members 31 in the upper/lower direction. That is, by the configuration of this embodiment, it is possible to reduce an increase in a height of the large capacity sheet feeder 10 due to the installation of the overturning prevention device. To be noted, the gap between the top portion of the wheel 21*a* and the support plate 21*d* is normally designed to include a relatively wide margin to enable the main shaft 21*c* to revolve, and it is possible to use the overturning prevention member 31 of this embodiment with a generally available wheel unit.

Further, since the holding member 41 is disposed on the inner side of the main shaft 21*c* of the wheel unit 21 with respect to the feeder apparatus body 11, it is possible to support the overturning prevention member 31 at a position where it is possible to easily acquire the adequate stiffness inside the frame body 49. Therefore, even in a case where a load is applied to the overturning prevention member 31, it is possible to minimize a deformation and the like of the frame body 49.

Further, in this embodiment, the held portion 31*c* and the connecting portion 31*f* of the overturning prevention member 31 are shaped to form the slit 31*a* which is a space portion to accommodate the main shaft 21*c* of the wheel unit 21. Herewith, it is possible to hold the overturning prevention member 31 by the holding member 41 with a simple operation of inserting the overturning prevention member 31 into the feeder apparatus body 11 from the outside to inside in the attaching direction D1. Especially, in this embodiment, since it is possible to hold the overturning prevention member 31 by the holding member 41 with the snap fit mechanism of the arms 31*b* disposed at the ends of the two parts of the held portion 31*c*, it is possible to complete the attachment of the overturning prevention member 31 with one action of an insertion in the attaching direction D1.

Variations

To be noted, although the configuration of fixing the holding members 41 to 44 from the lower side of the lower frame 50 by the screws 81 to 85 is described in the embodiment described above, it is acceptable to fix the holding members 41 to 44 to the lower side of the lower frame 50 by the other fastening method. For example, it is acceptable to fix the holding members 41 to 44 to the lower side of the lower frame 50 by a staking or swaging method (i.e., a joining method in which at least one of mating parts of two components is plastically deformed to come into press-fit or mechanical interlock). Further, if the holding members 41 to 44 constitute a part of the bottom surface of the feeder apparatus body 11 in a state fixed to the frame body 49, it is acceptable to fix the holding members 41 to 44 to a member other than the lower frame 50.

Second Embodiment

Hereinafter, a second embodiment will be described using FIGS. 8 to 11B. This embodiment is different from the first embodiment in a shape of an overturning prevention member and in integrated formation of a holding member with a lower frame of the feeder apparatus body. Hereinafter, the elements put with the same reference characters as the first embodiment have substantially the same configurations and functions as the first embodiment, and differences from the first embodiment will be mainly described.

Figure 8:
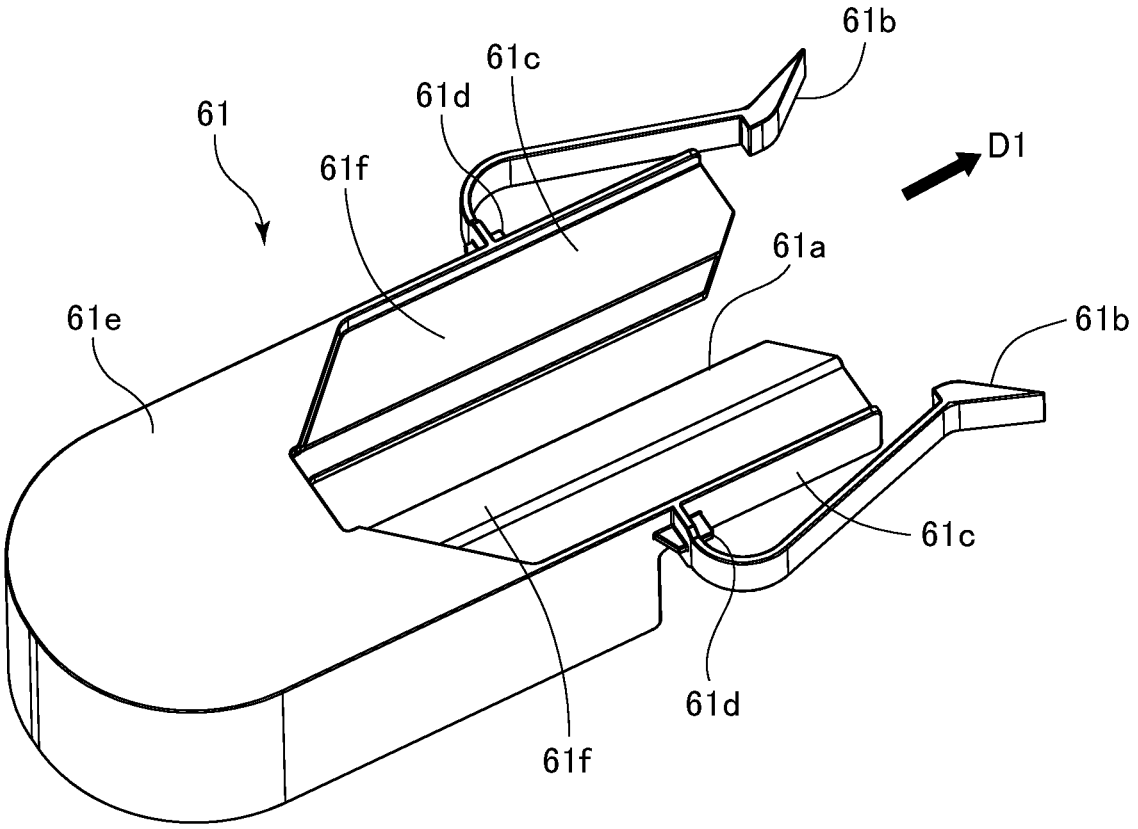
FIG. 8 is a perspective view of an overturning prevention member according to a second embodiment.
Figure 9:
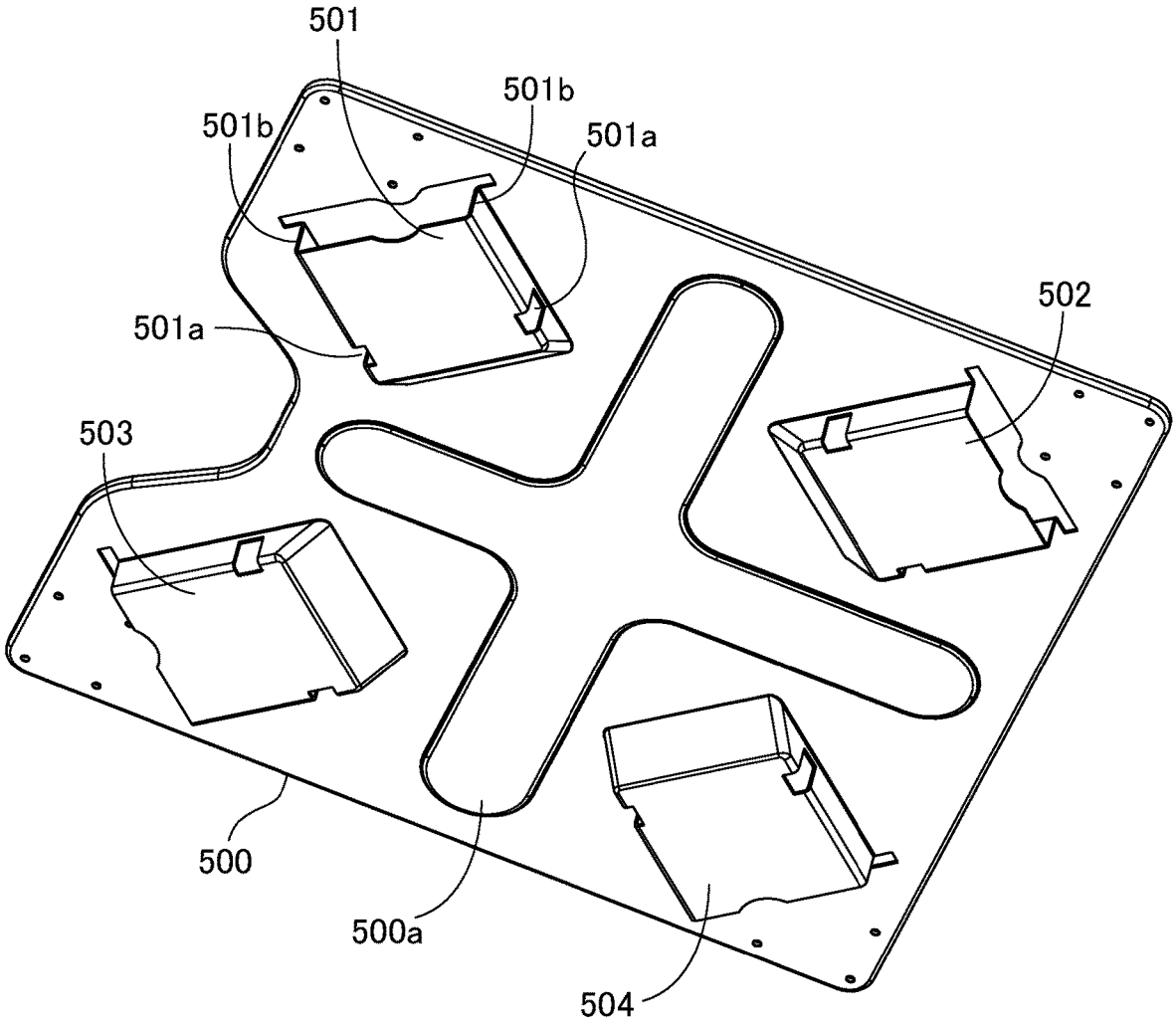
FIG. 9 is a perspective view showing a lower frame of the large capacity sheet feeder according to the second embodiment.
Figure 10:
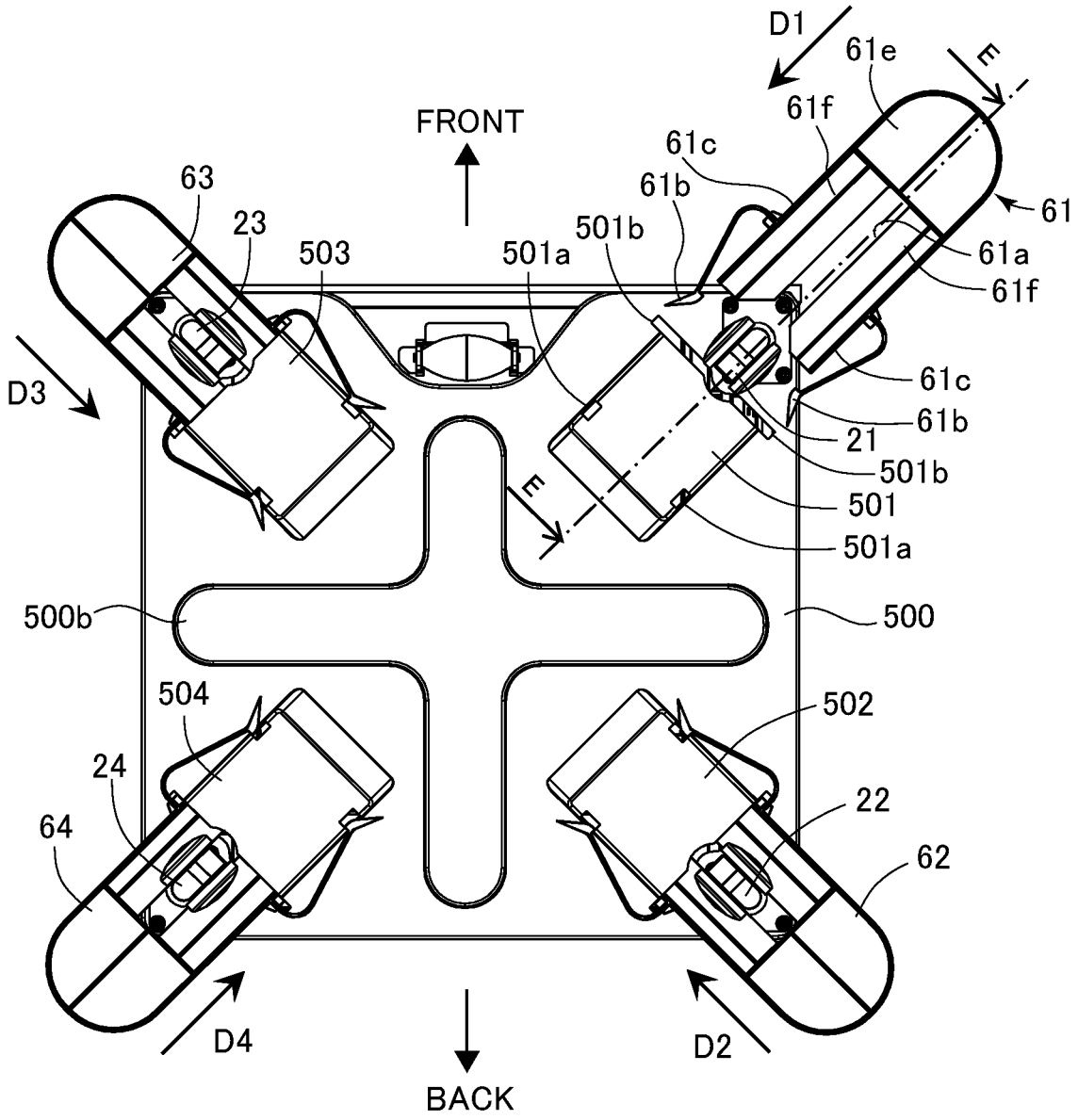
FIG. 10 is a bottom view of the large capacity sheet feeder for an explanation of a configuration of the overturning prevention member according to the second embodiment.
Figure 11A:
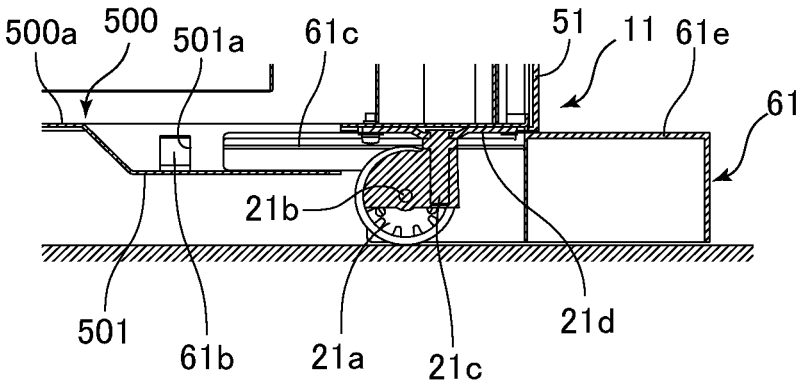
FIGS. 11A and 11B are cross-sectional views of the large capacity sheet feeder for the explanation of the configuration of the overturning prevention member according to the second embodiment.
Figure 11B:
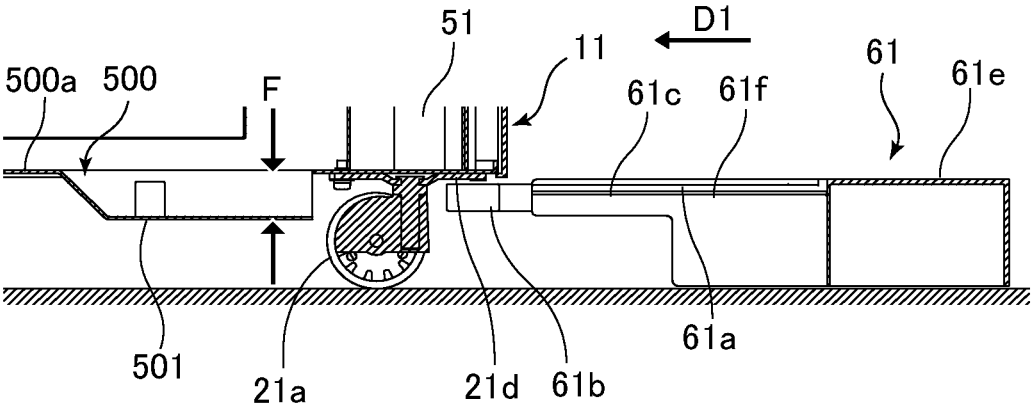

FIG. 8 is a perspective view showing one of the overturning prevention members according to this embodiment. FIG. 9 is a perspective view showing a lower frame 500 of this embodiment when viewed from below. FIG. 10 is a view of the large capacity sheet feeder 10 with the overturning prevention members 61 to 64 attached, when viewed from below. FIGS. 11A and 11B are cross-sectional views of the large capacity sheet feeder 10 taken along a line E-E of FIG. 10, and respectively show an attached state with the overturning prevention member 61 attached and a detached state (non-attached state) with the overturning prevention member 61 detached.

Since configurations of the overturning prevention members 61 to 64 are substantially the same, using the overturning prevention member 61 in FIG. 8, the configurations of the overturning prevention members 61 to 64 will be described. The overturning prevention member 61 includes a held portion 61*c*, a connecting portion 61*f*, and a grounding portion 61*e*.

The held portion 61*c* is a portion which is held by a holding member 501 of the feeder apparatus body 11. The held portion 61*c* is a portion which, when the overturning prevention member 61 is attached, is inserted into an attaching space F (refer to FIG. 11B) between the holding member 501 disposed at the lower frame 500 and a principal surface 500*a* of the lower frame 500. Hereinafter, a direction in which the overturning prevention member 61 moves so as to insert the held portion 61*c* into the attaching space F is referred to as an attaching direction D1 of the overturning prevention members 61.

The overturning prevention member 61 further includes a slit 61*a*, arms 61*b*, and contact portions 61*d*. Shapes of these parts are substantially the same as those in the first embodiment except that the arms 61*b* extend from the contact portions 61*d*, not being disposed at the ends of two parts of the held portion 61*c*. Having projected outside from the contact portions 61*d*, the arms 61*b* extend downstream in the attaching direction D1, and include a claw shape at ends so as to engage with the holding member 501.

Shapes of the grounding portion 61*e* and the connecting portion 61*f* are also similar to the shapes of the grounding portion 31*e* and the connecting portion 31*f* in the first embodiment. That is, the grounding portion 61*e* is a projecting portion which, when viewed from above, projects outside the lower frame 500 to face the installation surface of the large capacity sheet feeder 10 outside the lower frame 500. The connecting portion 61*f* is a portion which, when viewed from above, connects the held portion 61*c*, which is held by the holding member 501 on an inner side of the main shaft 21*c* of the wheel unit 21 with respect to the lower frame 500, and the grounding portion 61*e* projecting outside the lower frame 500.

As shown in FIGS. 4, 9 and 10, the wheel units 21 to 24 are fixed to the screw holes 50*b* disposed at four corners of a lower surface of the lower frame 500 by a plurality of screws.

Further, as shown in FIGS. 4 and 9, the holding members 501, 502, 503, and 504 of this embodiment are disposed in adjacent to the screw holes 50*b* which are disposed at four corners of the lower frame 50 to fix the wheel units 21 to 24. The holding members 501 to 504 are formed by a drawing method and the like from one sheet of a metal plate constituting the lower frame 500 so as to project below the principal surface 500*a* of the lower frame 500.

Each of the holding members 501 to 504 has an approximately rectangular shape with an upper side open (angular C-shape) when viewed in the attaching directions D1 to D4 of the corresponding overturning prevention members 61 to 64. Therefore, the attaching spaces F (refer to FIG. 11B) into which the overturning prevention members 61 to 64 are inserted in the predetermined attaching directions D1 to D4 are formed above the holding members 501 to 504 and below a height of the principal surface 500*a* of the lower frame 500 in the upper/lower direction.

To be noted, in this embodiment, a bending shape 500*b* which is a different pattern (cross shape) from the first embodiment is formed in the lower frame 500, and the holding members 501 to 504 are disposed at a distance from the bending shape 500*b*.

Hereinafter, using the overturning prevention member 61 as an example, an attaching method of the overturning prevention members 61 to 64 will be described. As shown in FIGS. 11B and 10, in a case attaching the overturning prevention member 61, an operator grips the overturning prevention member 61 with the held portion 61*c* directed downstream in the attaching direction D1, and aligns the slit 61*a* to face the main shaft 21*c* of the wheel unit 21. Then, the operator moves the overturning prevention member 61 in the attaching direction D1 from the outside to inside of the feeder apparatus body 11.

Hereupon, the held portion 61*c* move via the gap between the top portion of the wheel 21*a* and the support plate 21*d* in the upper/lower direction on both sides of the slit 61*a* while the slit 61*a* is accommodating the main shaft 21*c*. Further, the arms 61*b* of the overturning prevention member 61 come into contact with front side edge portions 501*b* disposed at an upstream edge of the holding member 501 in the attaching direction D1, and elastically deform outward (that is, so as to depart from each other).

When the overturning prevention member 61 is pushed further, the main shaft 21*c* relatively moves to the bottom side of the slit 61*a*, and the arms 61*b* moves to a side surface portion of the holding member 501 while sliding. Then, by bringing the contact portions 61*d* of the overturning prevention member 61 into contact with the front side edge portions 501*b* of the holding member 501, movement of the overturning prevention member 61 in the attaching direction D1 is restricted.

The holding member 501 holds the held portion 61*c* so that the overturning prevention member 61 is held at the attached position and brought into a state held by the feeder apparatus body 11. In this state, the arms 61*b* engage with recess portions 501*a* disposed on side surfaces of the holding member 501 so that the overturning prevention member 61 is prevented from dropping off from the holding member 501 to an upstream side in the attaching direction D1. In other words, the arms 61*b* of the overturning prevention member 61 and the recess portions 501*a* of the holding member 501 form a snap fit mechanism which prevents the overturning prevention member 61 from dropping off.

As shown in FIG. 11A, similar to the first embodiment, in the attached state where the overturning prevention member 61 is attached, it is designed to provide a predetermined gap between the grounding portion 61*e* of the overturning prevention member 61 and the installation surface 100. Since, when the external force is applied to the large capacity sheet feeder 10 so that the feeder apparatus body 11 starts to incline, the grounding portion 61*e* comes into contact with the installation surface 100, the frame body 49 of the feeder apparatus body 11 is supported by the overturning prevention member 61, and thus the overturning is prevented.

As described above, the holding member 501 which holds the overturning prevention member 61 is disposed on the inner side of the main shaft 21*c* of the wheel unit 21 with respect to the lower frame 500 in the attaching direction D1. Further, the grounding portion 61*e* projecting outside the lower frame 500 and the held portion 61*c* held by the holding member 501 inside the lower frame 500 are connected by the connecting portion 61*f* extending via the gap between the top portion of the wheel 21*a* and the support plate 21*d* in the upper/lower direction. By this configuration, it is possible to avoid overlapping the fitting position of the wheel unit 21 with the holding member 501 of the overturning prevention members 61 in the upper/lower direction, and possible to reduce the increase in the height of the large capacity sheet feeder 10 due to the installation of the overturning prevention device.

Further, since the lower frame 500 and the holding members 501 to 504 are formed as one piece of a member, the configuration is simpler in this embodiment.

Other Embodiments

Although, in the first and second embodiments described above, the overturning prevention member which is attached to the large capacity sheet feeder 10 feeding the sheet to the image forming apparatus and the like is described, this disclosure is not limited to this. For example, it is acceptable to dispose the overturning prevention member described in the embodiments at a bottom portion of the image forming apparatus body 1A in FIG. 12. Further, it is not limited to an apparatus which is used for a storage of recording material in the image forming apparatus, and, for example, it is acceptable to dispose the overturning prevention member described in the embodiments to a storage apparatus (cabinet) which stores a document and consumables. Furthermore, this disclosure is applicable to any apparatuses including a wheel unit.

Furthermore, it is acceptable to change an arrangement of the overturning prevention member pertinently. Although, in the first and second embodiments, the overturning prevention members are disposed at four corners of the bottom portion of the feeder apparatus body 11 and configured to project into diagonal directions of the bottom portion, it is acceptable to change a projecting direction and move the overturning prevention members to the middle portions between the corners of the bottom portion. Further, it is acceptable to change a number of overturning prevention members to equal to or less than three or equal to or more than five.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-083169, filed on May 11, 2020, which is hereby incorporated by reference herein in its entirety.

What is claimed is:

1. A sheet feeding apparatus comprising:

a sheet storage portion in which a sheet is stored;

a sheet feed unit configured to feed the sheet stored in the sheet storage portion;

an apparatus body configured to support the sheet storage portion, the apparatus body including a frame arranged below the sheet storage portion;

a wheel unit including a shaft fixed to the frame and extending downward from the frame, the wheel unit being pivotable with respect to the frame around the shaft;

a holding member provided in the frame; and an attachment member configured to be attached to the holding member in an attaching direction, wherein the holding member is downstream of the shaft in the attaching direction, and wherein the attachment member is configured to cover at least a part of the wheel unit in a state in which the attachment member is attached to and held by the holding member.

2. The sheet feeding apparatus according to claim 1, wherein the wheel unit further includes a wheel and a fitting portion, the fitting portion being fitted to the frame at a position above a top portion of the wheel, wherein the holding member is disposed at a position nearer to a center of the frame than the shaft when viewed from above, wherein the attachment member includes a projecting portion configured to project outside the frame when viewed from above and to face an installation surface on which the wheel is grounded; and a held portion configured to be held by the holding member, the projecting portion and the held portion being connected with each other via a gap between the top portion of the wheel and the fitting portion in a vertical direction.

3. The sheet feeding apparatus according to claim 2, wherein the attachment member is provided with a groove shape extending in the attaching direction and opened toward the attaching direction, the groove shape being configured to accommodate the shaft of the wheel unit in a case where the attachment member is attached to the holding member in the attaching direction.

4. The sheet feeding apparatus according to claim 3, wherein the held portion includes a first held part and a second held part which are disposed separately from each other in a direction intersecting with the attaching direction when viewed from above and each of which is configured to engage with the holding member, wherein the attachment member includes a first connecting part and a second connecting part, the first connecting part extending in the attaching direction and connecting the projecting portion with the first held part, the second connecting part extending in the attaching direction and connecting the projecting portion with the second held part, and wherein the groove shape is formed between the first connecting part and the second connecting part.

5. The sheet feeding apparatus according to claim 2, wherein the held portion includes a claw shape configured to be elastically deformable in a direction intersecting with the attaching direction, and wherein, in a state in which the attachment member is attached to a predetermined position in the attaching direction, the claw shape is engaged with the holding member such that the attachment member is prevented from dropping off from the holding member.

6. The sheet feeding apparatus according to claim 5, wherein the holding member is configured to form a hole in which the held portion of the attachment member is held, the hole being a penetrating hole in the attaching direction and being formed between the frame and the holding member in the vertical direction, wherein the claw shape is disposed at an end of the held portion in the attaching direction, and wherein, in the state in which the attachment member is attached to the predetermined position in the attaching direction, the claw shape projects downstream of the holding member in the attaching direction via the hole and engage with a downstream edge of the holding member in the attaching direction.

7. The sheet feeding apparatus according to claim 5, wherein the attachment member includes a contact portion that projects outside from a side surface of the attachment member in a direction intersecting with the attaching direction when viewed from above, the contact portion being configured to contact with an upstream edge of the holding member in the attaching direction in the state in which the attachment member is attached to the predetermined position in the attaching direction such that a movement of the attachment member in the attaching direction is restricted.

8. The sheet feeding apparatus according to claim 2, wherein the attachment member is one of four attachment members each disposed at one of four corners of the frame having a rectangular shape when viewed from above.

9. The sheet feeding apparatus according to claim 2, wherein the attachment member is formed of a synthetic resin.

10. The sheet feeding apparatus according to claim 2, wherein the projecting portion and the held portion of the attachment member are formed integrally as one component.

11. The sheet feeding apparatus according to claim 2, wherein the holding member is fixed to a lower surface of the frame by a screw.

12. The sheet feeding apparatus according to claim 2, wherein the holding member is fixed to a lower surface of the frame by a staking method or swaging method.

13. The sheet feeding apparatus according to claim 1, wherein the attachment member includes a projecting portion configured to project outside the frame that has a rectangular shape when viewed from above, wherein the holding member is arranged at a corner portion of the frame between a first side of the rectangular shape and a second side of the rectangular shape, and wherein both when viewed in a direction along the first side and when viewed in a direction along the second side, the projecting portion is configured to cover the wheel unit except for a gap between the projecting portion and an installation surface on which the wheel unit is grounded.

14. The sheet feeding apparatus according to claim 13, wherein in a case where the sheet feeding apparatus is inclined, the projecting portion is configured to come in contact with the installation surface such that the sheet feeding apparatus is prevented from overturning.

* * * * *